United States Patent [19]

Urien et al.

[11] 4,408,209

[45] Oct. 4, 1983

[54] ORIENTABLE BEAM ANTENNA FOR TELECOMMUNICATIONS SATELLITE

[75] Inventors: Jacques Urien; Bruno Vidal Sainte Andre, both of Paris, France

[73] Assignee: Thomson-CSF, Paris, France

[21] Appl. No.: 220,156

[22] Filed: Dec. 23, 1980

[30] Foreign Application Priority Data

Dec. 27, 1979 [FR] France ..... 79 31803

[51] Int. Cl.[3] ..... H01Q 1/50

[52] U.S. Cl. ..... 343/861; 343/705; 343/837

[58] Field of Search ..... 343/839, 836–838, 343/840, 781 R, 781 CA, 761, 705

[56] References Cited

U.S. PATENT DOCUMENTS 3,407,404 10/1968 Cook et al. ..... 343/838

3,914,768 10/1975 Ohm ..... 343/837

FOREIGN PATENT DOCUMENTS 905440 11/1958 United Kingdom .

*Primary Examiner*—David K. Moore

[57] ABSTRACT

The orientable beam antenna comprises a fixed source, a fixed first reflector and a mobile reflector. The axis of the source is offset with respect to the focal aspect of the fixed reflector, and the mobile reflector connected to the elements through a universal joint device having two orthogonal axes, enabling the mobile connections to be limited to commercially available bearings.

5 Claims, 2 Drawing Figures

1
2
3
4
5
6
7
8
9
10
11
12
13
14
15
16
17
18
19
20
21
22
23
24
A
F
0
α

ORIENTABLE BEAM ANTENNA FOR TELECOMMUNICATIONS SATELLITE

BACKGROUND OF THE INVENTION

The present invention relates to orientable beam antennae and more particularly those for use in the spatial vacuum, on board telecommunications satellites.

These antennae comprise mechanisms, involving bearing and sliding frictions, whose construction, with the high degree of reliability required for equipment carried on board satellites, constitutes a difficult and costly problem to resolve.

It is known to construct such antennae by means of a fixed device comprising a primary source illuminating a first reflector and a second mobile reflector illuminated by the preceding one. But the present constructions do not allow more than 2° or 3° of movement to be obtained, whereas it is desirable to obtain orientation variations of the radiated beam of at least ±30°.

SUMMARY OF THE INVENTION

The present invention aims at obtaining this result from known mechanical components, designed and qualified for operation in a spatial environment, and used in a limited number so as to attain an excellent reliability.

The invention provides then an orientable beam antenna comprising a first fixed source, a first reflector receiving the radiation emitted by the primary source with which it is mechanically integral and a second orientable reflector receiving the waves reflected by the first reflector, said antenna being characterized in that the primary source is a source which is offset so as not to intercept the waves reflected by the first reflector, the second reflector being mechanically coupled at its periphery to the primary source through a kinematic system.

DESCRIPTION OF THE DRAWINGS

The invention will be better understood and other characteristics will become apparent from the following description and the drawings which refer thereto and in which.

DESCRIPTION OF THE PREFERRED EMBODIMENT

Figures 1, 2:
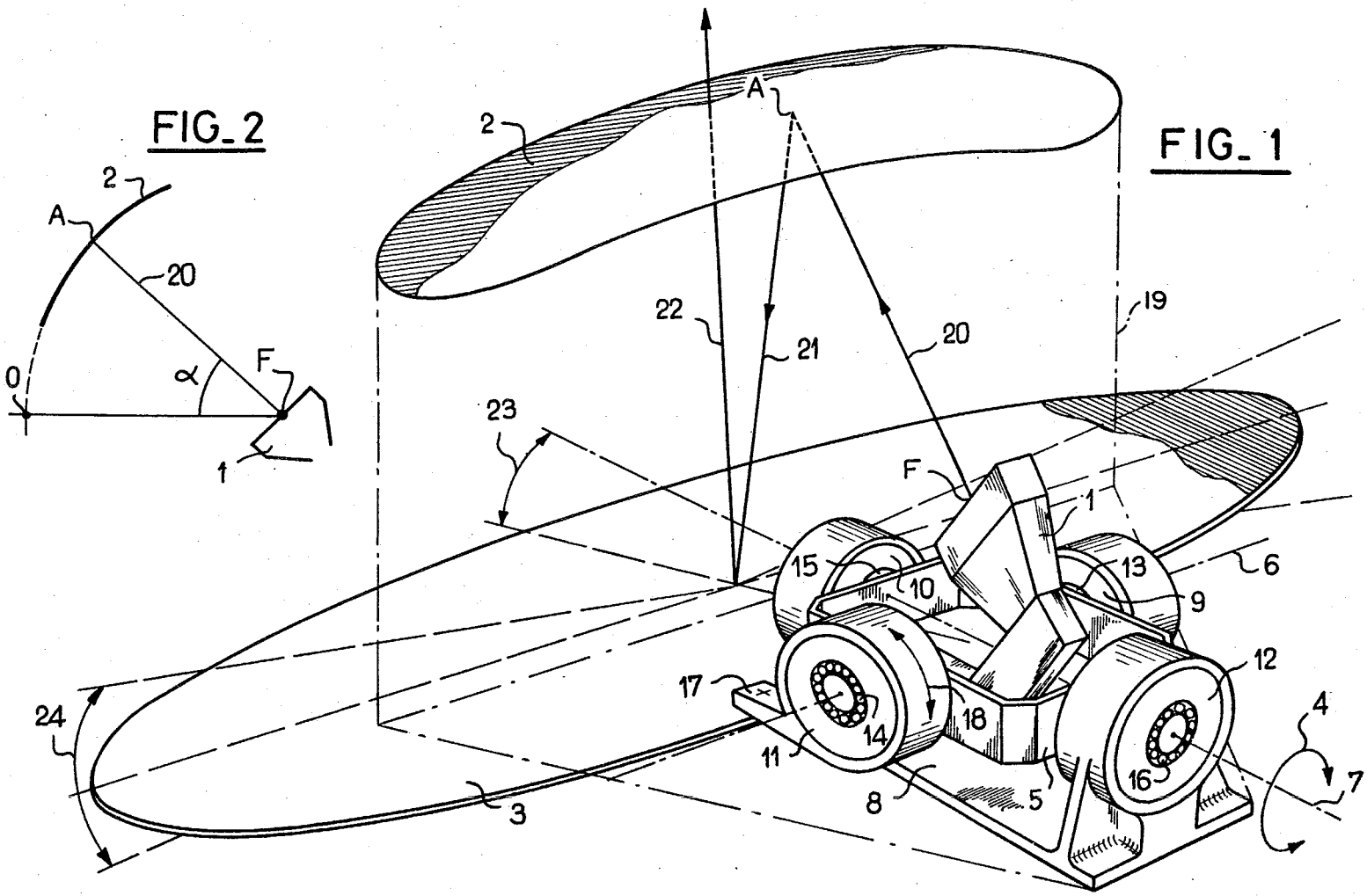
FIG. 1 is one embodiment of an orientable beam antenna in accordance with the invention.
FIG. 2 is a partial section of FIG. 1, taken in the plane of symmetry of the antenna.

In FIG. 1, a primary source of electromagnetic radiation 1 having an axis of symmetry 20 is mechanically integral with a frame 8 also supporting an auxiliary reflector 2, whose mechanical supporting elements 19 have been diagrammatically shown by dot-dash lines. This reflector is cut out from a paraboloid of revolution having an apex O (shown only in FIG. 2) and a focal point F, this latter being contained in the plane of symmetry of the antenna and situated at the level of the mouth of source 1. Axis 20, which intersects reflector 2 at a point A, forms with the straight line FO and angle $\alpha$ (FIG. 2) in accordance with a conventional so-called "off set" assembly.

Frame 8 also supports a shaft 7 through two ball bearings 13 and 14. Around this shaft 7 pivots (in the direction of arrow 4) a cradle 5 which in turn supports a shaft 6, orthogonal to shaft 7, through two ball bearings 13 and 14.

A principal flat reflector 3 is movable about shaft 6. It is mechanically fixed, at its periphery, through two fixing lugs only one of which, 17, can be seen in the figure, to mobile elements 11 and 9 forming respectively the rotors of a motor and a angle measuring transducer which rotate (in the direction of arrow 18) about this shaft 6 with which the stators are integral. Conversely, the rotors of a motor and a resolver are integral with each end of shaft 7, with stators 10 and 12 integral with frame 8 corresponding respectively thereto.

The auxiliary reflector 2 is formed from parallel conducting wires (partially shown in FIG. 1) whose diameter and pitch are chosen so as to act like a polarizing filter reflecting for waves having the same polarization as those emitted by source 1 and transparent for those polarized orthogonally with respect to the preceding ones.

The flat reflector 3 is formed from parallel equidistant wires (also partially shown in FIG. 1) designed similarly to those of reflector 2 but so that the polarization of the reflected waves is then crossed. Thus a ray emitted by source 1 along axis 20 is reflected at A by reflector 2 if it presents the correct polarization. It propagates along axis 21 to be reflected along axis 22 with a polarization perpendicular to the preceding one allowing it to pass without appreciable attenuation through reflector 2. This axis 22 may assume any direction among those which are possible in a conical portion of the space whose opening angles are respectively proportional to the angles of movement 23 and 24 defined by the rotation of the corresponding shafts 6 and 7.

Such a structure comprises, for mobile connections, only commercial mechanical components, namely ball bearings designed and qualified for operation in a spatial environment, which avoids having to carry out research work on specific devices requiring corresponding means and whose performances do not always correspond to what is expected of them.

Of course the structure described is only an example.

Another form may be given to reflector 2, in particular, it may be cut out from a parabolic cylinder and associated with a linear source, that is to say wide in a parallel direction at the location of the focal points of this reflector.

The mobile reflector 3 is not necessarily flat but may, for example, be parabolic. Similarly, the network of parallel wires may be replaced by grooves cut out in a solid shape.

It is not necessary either for fixed reflector 2 to play the role of polarization filter and so for the mobile reflector to cause polarization crossing, to the extent that the directions of the space where it is desired to cause the antenna to radiate prevent the beam reflected by mobile reflector 3 from meeting fixed reflector 2. Similarly, the universal joint kinematic system for two shafts may be replaced by a system causing rotation of a single shaft if the restriction in sweeping space which results therefrom is admissible for use thereof.

Finally, the bearings may be of any other known type, plane journal bearings for example, insofar as they present the required quality.

What is claimed is:

1. In an orientable beam antenna comprising a fixed primary source on board a satellite operable in spatial vacuum: a first reflector mechanically integral with the primary source and receiving the radiation emitted by the primary source, and a second orientable reflector receiving the waves reflected by the first reflector, the primary source being offset so as not to intercept the waves reflected by the first reflector, and a kinematic system mechanically coupling the second reflector at its periphery to the primary source.

2. The antenna as claimed in claim 1, wherein said second reflector is a flat reflector and said kinematic system is a universal joint device comprising two orthogonal axes of rotation one of which is supported by a frame integral with the source and with the first reflector, the other serving as the pivot for said second reflector.

3. The antenna as claimed in claim 2, wherein each axis is defined by a shaft and each shaft rests on two bearings equipped respectively with a motor and angle measuring transducer whose rotors and stators are mechanically integral with the respective shaft.

4. The antenna as claimed in any one of claims 1 to 3, wherein the first reflector is paraboloidal and acts like a polarizing filter, reflecting the waves radiated by the primary source along a first axis and transparent for these same waves then reflected by the second reflector along a polarization axis orthogonal with respect to the first axis.

5. The antenna as claimed in any one of claims 1 to 3, wherein said first reflector is cylindro-parabolic and said primary source has a linear structure, i.e. wide in a direction parallel to the location of the focal points of said first reflector.

* * * * *